United States Patent [19]

Boursier

[11] 4,280,648

[45] Jul. 28, 1981

[54] MOLDED PAPER PULP CONTAINER

[75] Inventor: Léon Boursier, Paris, France

[73] Assignee: Keyes Fibre Company, Waterville, Me.

[21] Appl. No.: 93,313

[22] Filed: Nov. 13, 1979

[30] Foreign Application Priority Data

Nov. 16, 1978 [FR] France ..... 78 32355

[51] Int. Cl.[3] ..... B65D 21/02; B65D 1/36

[52] U.S. Cl. ..... 229/2.5 EC; 206/520; 206/519

[58] Field of Search ..... 229/2.5 EC, 29 R; 206/519, 517, 520

[56] References Cited

U.S. PATENT DOCUMENTS

| | | | |
|---|---|---|---|
| 2,420,215 | 5/1947 | Wiley | 206/519 |
| 3,286,833 | 11/1966 | Chadbourne | 206/517 |
| 3,442,420 | 5/1969 | Edwards | 206/520 |
| 3,539,552 | 11/1970 | Mounts et al. | 206/519 |
| 3,963,172 | 6/1976 | Holzwarth et al. | 229/2.5 EC |
| 4,081,123 | 3/1978 | Reifers | 229/2.5 EC |
| 4,127,189 | 11/1978 | Shumrak | 206/520 |
| 4,156,483 | 5/1979 | Day | 206/520 |

FOREIGN PATENT DOCUMENTS

| | | | |
|---|---|---|---|
| 2253736 | 11/1972 | Fed. Rep. of Germany | 206/519 |
| 1398698 | 6/1975 | United Kingdom . | |

*Primary Examiner*—Davis T. Moorhead

*Attorney, Agent, or Firm*—Connolly and Hutz

[57] ABSTRACT

A molded paper pulp container comprising a pocketed section mutually hinged to a flat bottom cover section, both said sections comprising tapered walls bordering on said hinge, the external surfaces of said tapered walls bordering on said hinge comprising projecting abutting elements cooperating together to limit the inverted folding around said hinge. The molded paper pulp containers, mainly egg cartons, may be stacked in their flat open condition with the bottoms of the cover sections of a number of stacked containers maintained parallel thus allowing easy unstacking by mechanical devices such as suction-cups equipped unstackers.

5 Claims, 5 Drawing Figures

Fig.1.
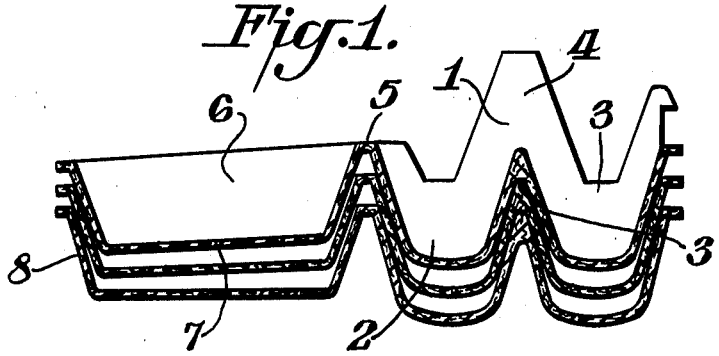
Fig.2.
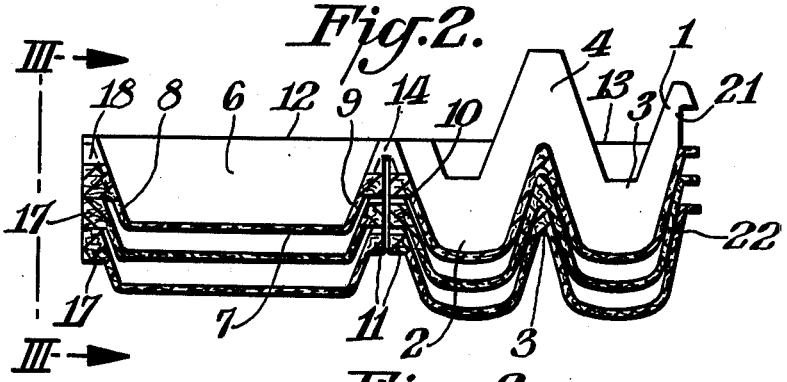
Fig.3.
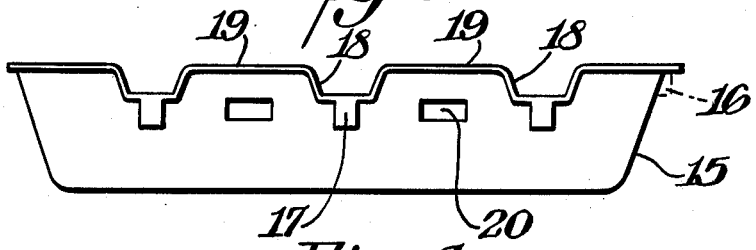
Fig.4.
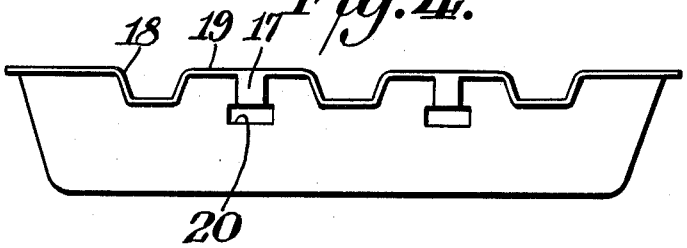
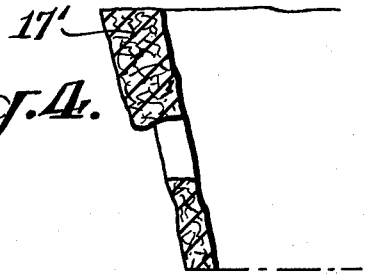
Fig.4.

MOLDED PAPER PULP CONTAINER

BACKGROUND OF THE INVENTION

The invention relates to molded containers made of paper pulp. Such containers must have tapered sidewalls in order to allow their withdrawing from the molding die, and to be stackable to reduce the storage volume. On the other hand automated packing machines used for the containers necessitate an unstacking which is as easy as possible, when done either manually or with a mechanical unstacker.

The containers in the form of boxes, mainly egg cartons, comprise a section with pockets and a cover section which are joined along a common edge acting as a hinge. When stacked the cover sections nest mutually, as do the pocketed sections. Nevertheless, as is well known, nesting is limited to the maximal thickness in the nesting direction, that is to the length of the cut along a plane parallel to said direction, if the element is perfectly rigid. In the case of a slanted wall, the nesting distance is equal to the wall thickness divided by the sine of the slanting angle. With walls of very low thickness approximating 1 millimeter, as those made of molded paper pulp which have been pressure finish-formed after molding, and which have a taper angle over 10°, this nesting distance approximates 2.5 millimeters. Moreover, in case of tight nesting, adherence by suction occurs between the smooth surfaces which opposes easy unstacking. To increase the nesting distance i.e. the distance between two stacked containers, it is necessary to give additional thickness to some parts along the stacking direction, additional thicknesses being built up during molding in the pocketed section through pulp settling in the dihedrons between the pockets, settling which generates vertical thicknesses approximating one centimeter.

Accordingly during stacking the cover sections tend to nest mutually to a much higher degree than the pocketed sections. Due to the fact that their bottom surface must be flat, to be able to be printed or labelled, embossings obtained through pulp settlings cannot be used on this part for aesthetic and practical reasons.

Moreover, in view of the hinge between the cover and the pocketed sections, the nesting of the cover sections is not restricted by the nesting of the pocketed sections, and a roof-like inverted folding occurs which is accentuated when the number of stacked cartons is higher, and unstacking proves to be more difficult and hazardous.

SUMMARY OF THE INVENTION

The present invention has for its object to remedy these drawbacks and to provide a stacking with a flat nesting of molded paper pulp containers comprising a pocketed section mutually hinged to a flat bottom cover section, both said sections comprising tapered portions bordering on said hinge, the external surfaces of the tapered portions bordering on said hinge comprising projecting abutting elements cooperating together to limit the inverted folding around the hinge. Inverted folding means folding in the direction opposite that according to which the cover section is shut or closed up, over and down on the pocketed section.

Preferably the abutting elements are provided around at least a part of the cuttings or window openings formed in the tapered walls bordering said hinge.

With this feature said inverted folding of the container around the hinge is avoided, and one obtains when stacking a nesting depth which is the same for both the pocketed sections and the cover sections. Nevertheless the cover section projects laterally relative to the pocketed section, and the hinge is weakened by the cuts or windows necessary to position the abutting elements away from the hinge without unduly increasing the stacking distance, with the result that the cover section might be damaged due to the pressure or other similar force exerted by the unstacking device.

To remedy this drawback, and according to another feature of the said invention, at least one complementary abutting element is provided on the tapered surface of the cover section opposite to the hinge, said abutting element cooperating with the cover section of the container juxtaposed thereto in the stack.

Said complementary abutting element, which in practice may be formed through an increased deposit of pulp on the shaping or forming mold, is necessarily arranged on the external surface of the cover section, and is dimensioned relative to the corresponding free edge of the cover section to be in a plane perpendicular to the hinge, with a thickness substantially equal to the nesting distance of the pocketed element. Accordingly, in the nested position of two pocketed sections, the lower point of the abutting element of the cover section of the upper container abuts against the free edge of the cover section of the underlying container.

BRIEF DESCRIPTION OF THE DRAWINGS

Numerous advantages of the present invention will become apparent from a reading of the detailed description in conjunction with the accompanying drawings in which:

FIG. 1 is a transverse sectional elevational view of a stack of molded paper pulp containers according to the prior art;

FIG. 2 is a corresponding transverse sectional elevational view of a stack of containers according to the present invention;

FIG. 3 is a side elevational view from line III—III of FIG. 2 of a container according to the present invention;

FIG. 4 is a view analogous to FIG. 3 of a container according to a modified embodiment;

FIG. 5 is a detail sectional view showing the shape of the abutting elements.

DETAILED DESCRIPTION OF THE INVENTION

The molded paper pulp container according to the prior art shown in FIG. 1 comprises a section 1 in which are formed pockets 2 intended to receive the eggs which are separated through ribs 3 and posts 4. On one of the margins 5 of said section is hinged, through a folding line, a cover forming section 6 comprising primarily a flat bottom surface 7 and slanted side walls 8. In the dihedrons corresponding to the ribs 3 there generally exist additional pulp thicknesses, and on stacking of the open containers, sections 1 are less nested, i.e. are less tightly stacked, than in the nesting which otherwise would be permitted by the thickness of the cover forming section 6. As a result, on stacking, the containers fold around the hinge 5 in a direction opposite to that corresponding to shutting down of the cover on the carton body, as illustrated in FIG. 1. Such stacking makes for very difficult unstacking, particularly because of the joining or jamming suction action between the nested surfaces at the outer portions 8 of the cover section.

According to the present invention, and as illustrated in FIG. 2, protruding abutment forming elements 11 are provided on the external faces of the tapered surfaces 9 and 10 merging in the hinge 5 of the cover and pocketed sections, said protruding elements 11 coacting when the container is opened flat to prevent inverted folding around the hinge 5. Surfaces 12 through which the cover section rests on surfaces 13 of the pocketed section remain, accordingly, at the same level or in the same plane as said surfaces 13, and the bottoms 7 of the cover sections of the stacked cartons remain mutually parallel. Abutments 11 are formed along the lower edge of cuts or windows 14 mold-formed in the upper margin of the tapered walls 9 and 10 bordering the hinge 5. The height of the abutments 11 off-set in this manner relative to the hinge may be reduced, and may even be of the same order as the thickness of the wall, particularly if nesting is restricted by abutments provided on the wall 8 of the cover section opposite to the hinge 5 as hereafter described.

Indeed with the restriction of the inverted folding obtained through abutments 11, the cover section projects laterally and is loosely overhung in the stack. This is a drawback, particularly in the case of an unstacking device using suction means, because the pressure exerted by the suction-cups on the bottom 7 can produce a folding around the hinge 5, or even a breaking of the hinge, which is weakened by the windows 14.

To avoid this drawback, the tapered wall 8 on the side opposite the hinge 5 of the cover section is provided with thicker parts which, by resting on the corresponding part of the margin of the underlaying carton in the stack restrict overly deep nesting of the cartons. It has previously been proposed to restrict nesting through external protruding parts 16 on the lateral sides 15 (FIG. 3) of the cover section, but said protruding parts which are transverse off-set parts of the wall rest only on the edge of the corner of the dihedron of the underlaying element through a very reduced surface, and are liable even under light pressure to nest in the underlying cover part.

The additional abutment forming ticknesses 17 may be set either at the lower part of the windows 18 provided in the wall 8 as shown in FIGS. 2 and 3, or between the rim 19 and the openings 20 for the hooks 21 to secure closing of the box, as illustrated in FIG. 4. Windows 18 are similar to 14 and windows 14 together and windows 18 in combination with similar windows provided in the wall 22 of the pocketed section form in the closed carton, windows allowing the eggs in the pockets to be seen.

Working out the sufficiently accurate abutting surfaces is made easier by the manufacturing process in which the paper pulp products are first suction molded and then finish-dried through compression between mating finishing dies. Indeed the finish-shaping may be performed with a very slight tapering, indeed practically no tapering, for parts of reduced area of the molded product while being formed on a suction surface always necessitates a considerable taper. Accordingly, and as shown in FIG. 5, the abutment forming over-thicknesses 11 and 17 are molded as shown in 17' with a noticeable taper and are pressure shaped in the following die drying step in order to obtain abutting surfaces parallel or perpendicular to the unmolding direction.

While the above described embodiments constitute the preferred mode of practicing this invention, other embodiments and equivalents may be resorted to within the scope of the actual invention which is claimed as:

1. A molded pulp container comprising a pocketed bottom section mutually hinged to a flat bottom cover section, both said sections comprising tapered walls bordering on said hinge, the external surfaces of said tapered walls bordering on said hinge having projecting abutting elements which cooperate together to limit inverted folding around said hinge.

2. A molded pulp container according to claim 1 in which windows are formed in the tapered walls bordering on said hinge, and the abutting elements are provided around at least a part of the windows bordering on the hinge.

3. A molded pulp container according to claim 1 in which at least one supplementary abutting element is formed in the external surface of the tapered wall of the cover section opposite to the hinge, this abutting element cooperating with the cover section of the underlying container in the stack.

4. A molded pulp container according to claim 3 in which the abutting elements are formed by an increased deposit of pulp in the area under the lower part of the windows provided in the edge of the tapered walls of the cover section.

5. A molded pulp container according to claim 3 in which the supplementary abutting element is formed by an increased deposit of pulp between the edge of the tapered wall of the cover section and openings provided in said wall for receiving closure hooks.

* * * * *